US005535684A

United States Patent [19]

John

[11] Patent Number: 5,535,684

[45] Date of Patent: Jul. 16, 1996

[54] ROTATABLE ELECTRICAL EQUIPMENT TABLE

[76] Inventor: Glenn G. John, 525 S. Shellman Ave., San Dimas, Calif. 91773

[21] Appl. No.: 345,859

[22] Filed: Nov. 28, 1994

[51] Int. Cl.[6] ..... A47B 37/00

[52] U.S. Cl. ..... 108/50; 108/142; 248/425

[58] Field of Search ..... 108/50, 22, 94, 108/103, 104, 139, 142, 93, 141; 248/522, 415, 418, 425

[56] References Cited

U.S. PATENT DOCUMENTS

| | | | |
|---|---|---|---|
| D. 161,714 | 1/1951 | Shapiro | 108/103 X |
| 1,225,228 | 5/1917 | Eddingsaas | 108/139 X |
| 1,775,577 | 9/1930 | Wilson | 108/142 |
| 1,947,801 | 2/1934 | Russell | 108/50 X |
| 2,589,719 | 3/1952 | McKinney | 108/50 X |
| 2,681,690 | 6/1954 | Johnson et al. | 248/425 X |
| 4,229,060 | 10/1980 | Brownlee et al. | 108/142 X |
| 4,237,796 | 12/1980 | Gordon et al. | 108/139 X |
| 4,408,543 | 10/1983 | Griffin | 108/50 X |
| 4,782,764 | 11/1988 | Robinson | 108/104 X |
| 4,815,392 | 3/1989 | Sööt | 108/94 X |

*Primary Examiner*—Peter M. Cuomo
*Assistant Examiner*—Janet M. Wilkens

[57] ABSTRACT

A rotatable electrical equipment table comprising: a support stand having at least one leg, the upper extent of each leg being coupled to a cross bar with an upwardly extending shaft, a support plate being formed in a planar configuration, the planar plate being coupled to the upper extent of the shaft; a lazy susan having upper and lower segments formed in a planar configuration, bearings being positioned between the upper and lower segments to permit rotation of one segment with respect to the other, the lower segment of the lazy susan being coupled to the support plate; and a worktable formed in a planar configuration, the worktable being coupled to the upper segment of the lazy susan, the worktable including a pull handle to facilitate rotation to the desired position, an extension pole formed in an elongated configuration with an upper extent and a lower extent, the lower extent being coupled to the table, a multiple outlet utility box including at least one electrical socket and being affixed to the upper extent of the extension pole, the box including an electrical extension cord.

1 Claim, 4 Drawing Sheets

ROTATABLE ELECTRICAL EQUIPMENT TABLE

BACKGROUND OF THE INVENTION

1. Field of the Invention

The present invention relates to a rotatable electrical equipment table and more particularly pertains to supporting up to four electrically powered tools on a rotatable table thereby enabling the user to select and utilize a particular tool while remaining stationary.

2. Description of the Prior Art

The use of work tables is known in the prior art. More specifically, work tables heretofore devised and utilized for the purpose of supporting tools thereupon are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. Des. 292,154 to Worrell a work table or similar article.

U.S. Pat. No. 4,444,125 to Welsch discloses a knock down work table.

U.S. Pat. No. 4,502,518 to Lewin discloses a work table for saws and other tools.

U.S. Pat. No. 4,260,307 to Mickelson discloses a work table for machine tools.

Lastly, U.S. Pat. No. 5,083,241 to Foster discloses a portable light/table.

In this respect, the rotatable electrical equipment table according to the present invention substantially departs from the conventional concepts and designs of the prior art, and in doing so provides an apparatus primarily developed for the purpose of supporting up to four electrically powered tools on a rotatable table thereby enabling the user to select and utilize a particular tool while remaining stationary.

Therefore, it can be appreciated that there exists a continuing need for a new and improved rotatable electrical equipment table which can be used for supporting up to four electrically powered tools on a rotatable table thereby enabling the user to select and utilize a particular tool while remaining stationary. In this regard, the present invention substantially fulfills this need.

SUMMARY OF THE INVENTION

In view of the foregoing disadvantages inherent in the known types of work tables now present in the prior art, the present invention provides an improved rotatable electrical equipment table. As such, the general purpose of the present invention, which will be described subsequently in greater detail, is to provide a new and improved rotatable electrical equipment table and method which has all the advantages of the prior art and none of the disadvantages.

To attain this, the present invention essentially comprises a new and improved rotatable electrical equipment table comprising, in combination: a support stand fabricated of generally rectangular shaped steel tubing and including two generally A-shaped segments, each segment having two legs angled outwardly from top to bottom, a top piece being positioned horizontally across the upper extent of each leg, a cylindrical shaped foot pad being affixed to the lower extent of each leg, a cross bar being welded to the top piece of each A-shaped segment, the center point of the cross bar having an upperwardly extending shaft, the legs of each opposing segment being coupled together by planar rectangular shaped rods; a support plate being fabricated of steel and formed in a planar rectangular configuration, the corners of the plate each having a circular hole extending therethrough, the approximate center point of the plate being welded to the upper extent of the shaft; a one thousand pound lazy susan having upper and lower segments formed in a planar circular configuration, the upper segment having a larger diameter than the lower segment, a plurality of bearings being positioned between the segments and permitting rotation of one segment with respect to the other, each segment having four equidistantly spaced holes adjacent to their respective edges, four screws coupling the lower segment of the lazy susan to the support plate through their aligned holes; a lock pin assembly formed in a generally L-shaped configuration, a first section of the assembly formed in a planar rectangular configuration and affixed to the lower segment of the lazy susan, the second section formed as a downwardly extending rectangular box with a spring positioned therein, the second section having an aperture extending vertically therethrough, a pull handle formed as a spherical ball with an extension rod extending upwardly therefrom, the rod being positioned through the apertures in the second section and coupled to the spring, the pull handle being pulled downward to rotate the table, upon release the resilient spring forcing the extension rod upward into a bore in the lower surface of the table locking it in place; a worktable having a top piece and a bottom piece, each piece formed in a planar rectangular configuration with an upper surface and a lower surface, the pieces being coupled together with glue and screws, the top piece having a plastic coating on its upper surface, each piece having four screw holes positioned therein, the bottom piece being coupled to the upper segment of the lazy susan with four screws through their aligned holes, the lower surface having a semi spherical shaped bore adjacent to the center point of each of its four side edges; an extension pole fabricated of generally rectangular shaped steel tubing and having an upper extent and a lower extent, the lower extent including a planar plate with screw holes, the plate being coupled to the center point of the table with four screws, a four outlet utility box formed in a generally rectangular configuration, the box including four electrical sockets and the associated hardware, the box being affixed to the upper extent of the extension pole, the box including an electrical extension cord with a male outlet plug.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotatable electrical equipment table which has all of the advantages of the prior art work tables and none of the disadvantages.

It is another object of the present invention to provide a new and improved rotatable electrical equipment table which may be easily and efficiently manufactured and marketed.

It is further object of the present invention to provide a new and improved rotatable electrical equipment table which is of durable and reliable constructions.

An even further object of the present invention is to provide a new and improved rotatable electrical equipment table which is susceptible of a low cost of manufacture with regard to both materials and labor, and which accordingly is then susceptible of low prices of sale to the consuming public, thereby making such rotational electrical equipment table economically available to the buying public.

Still yet another object of the present invention is provide a new and improved rotatable electrical equipment table which provides in the apparatuses and methods of the prior art some of the advantages thereof, while simultaneously overcoming some of the disadvantages normally associated therewith.

Still another object of the present invention is to support up to four electrically powered tools on a rotatable table thereby enabling the user to select and utilize a particular tool while remaining stationary.

Lastly, it is an object of the present invention to provide a new and improved rotatable electrical equipment table comprising: a support stand having at least one leg, each leg having an upper extent and a lower extent, the upper extent of each leg being coupled to a cross bar with an upwardly extending shaft, the shaft being formed of metal tubing, a support plate being formed in a planar configuration, the planar plate being coupled to the upper extent of the shaft; a lazy susan having upper and lower segments formed in a planar configuration, bearings being positioned between the upper and lower segments to permit rotation of one segment with respect to the other, the lower segment of the lazy susan being coupled to the support plate; and a worktable formed in a planar configuration, the worktable being coupled to the upper segment of the lazy susan, the worktable including a pull handle to facilitate rotation to the desired position, an extension pole formed in an elongated configuration with an upper extent and a lower extent, the lower extent being coupled to the table, a multiple outlet utility box including at least one electrical socket and being affixed to the upper extent of the extension pole, the box including an electrical extension cord.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the rotational electrical equipment table constructed in accordance with the principles of the present invention.

The same reference numerals refer to the same parts through the various Figures.

DESCRIPTION OF THE PREFERRED EMBODIMENT

Figure 2:
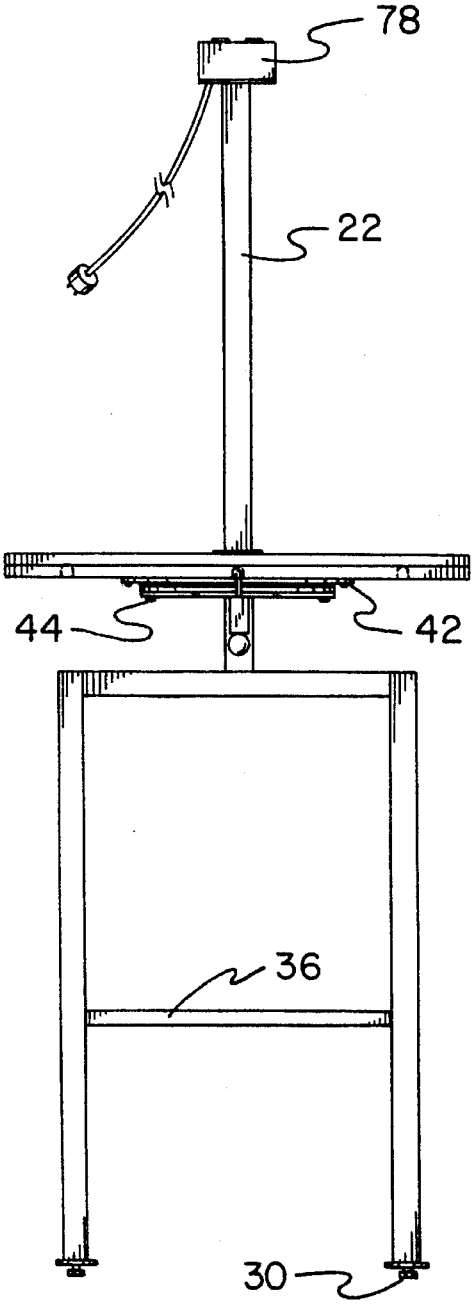
FIG. 2 is a front perspective view of the apparatus shown in FIG. 1.

With reference now to the drawings, and in particular to FIG. 1 thereof, the preferred embodiment of the new and improved rotatable electrical equipment table embodying the principles and concepts of the present invention and generally designated by the reference numeral 10 will be described.

The present invention, the rotatable electrical equipment table 10 is comprised of a plurality of components. Such components in their broadest context include a support stand 12, a support plate 14, a one thousand pound lazy susan 16, a worktable 18, a lock pin assembly 20 and an extension pole 22. Such components are individually configured and correlated with respect to each other so as to attain the desired objective.

Figure 3:
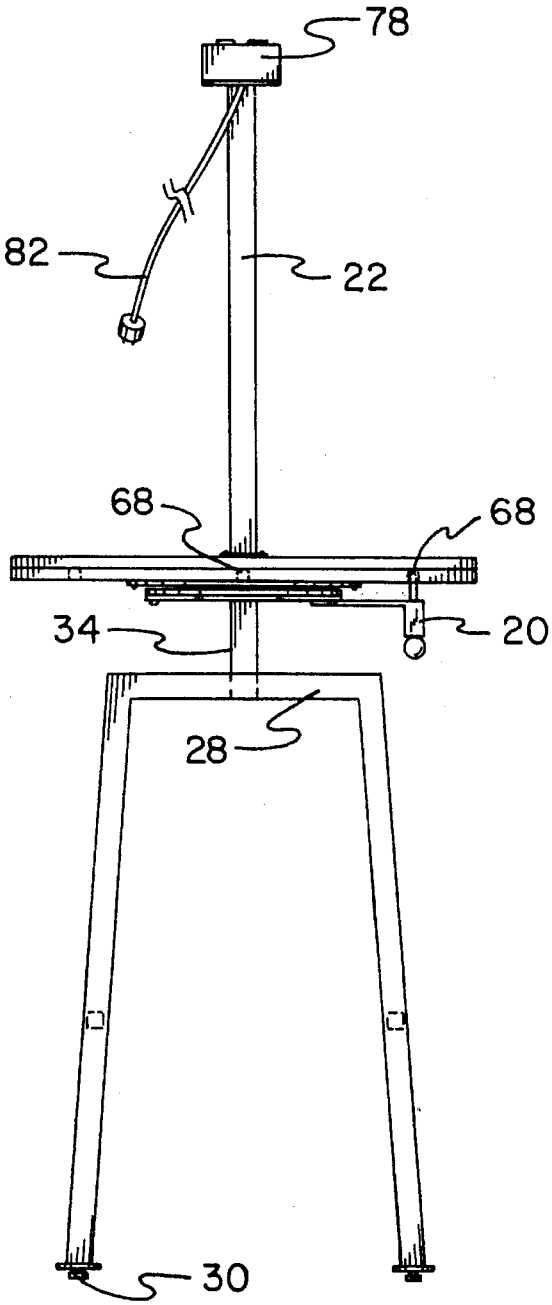
FIG. 3 is a side perspective view of the apparatus illustrating the positioning of the lock pin assembly.
Figure 2:
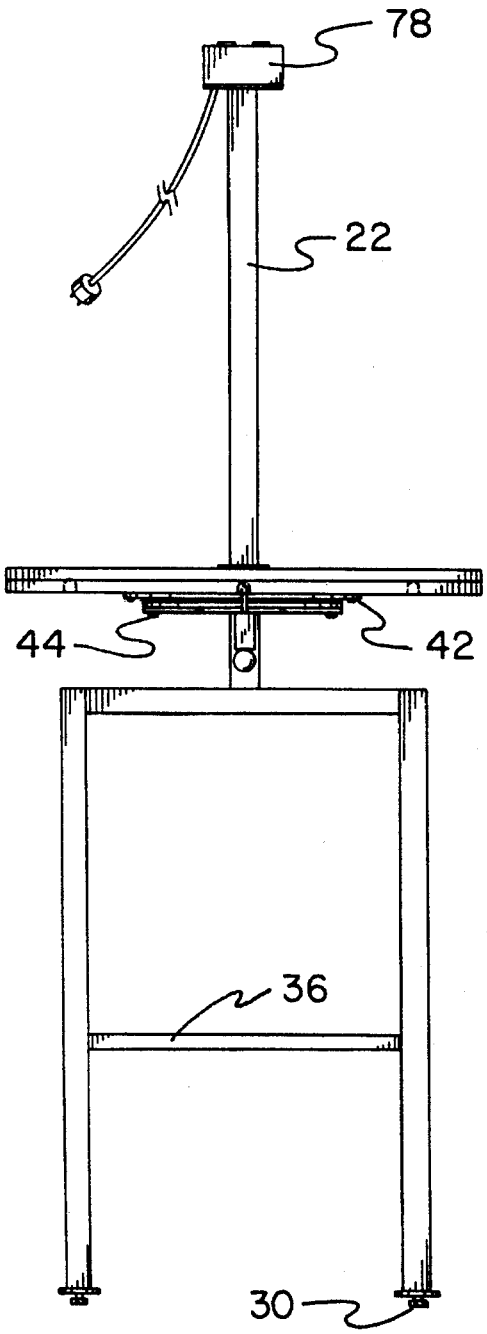
Figure 3:
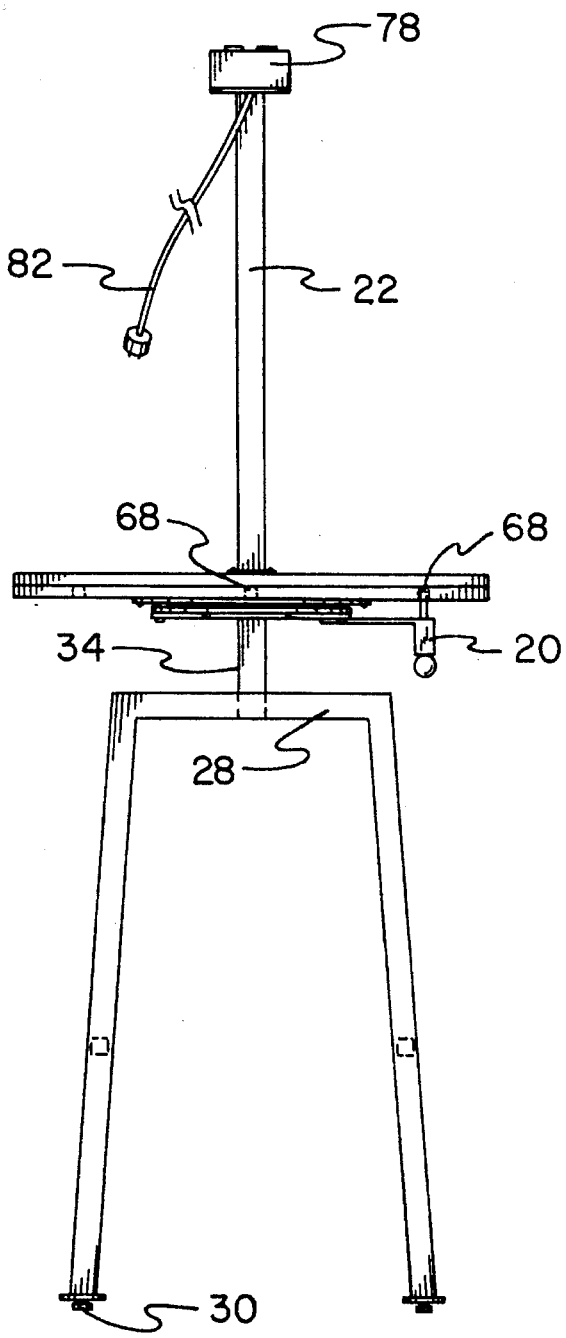
Figure 6:
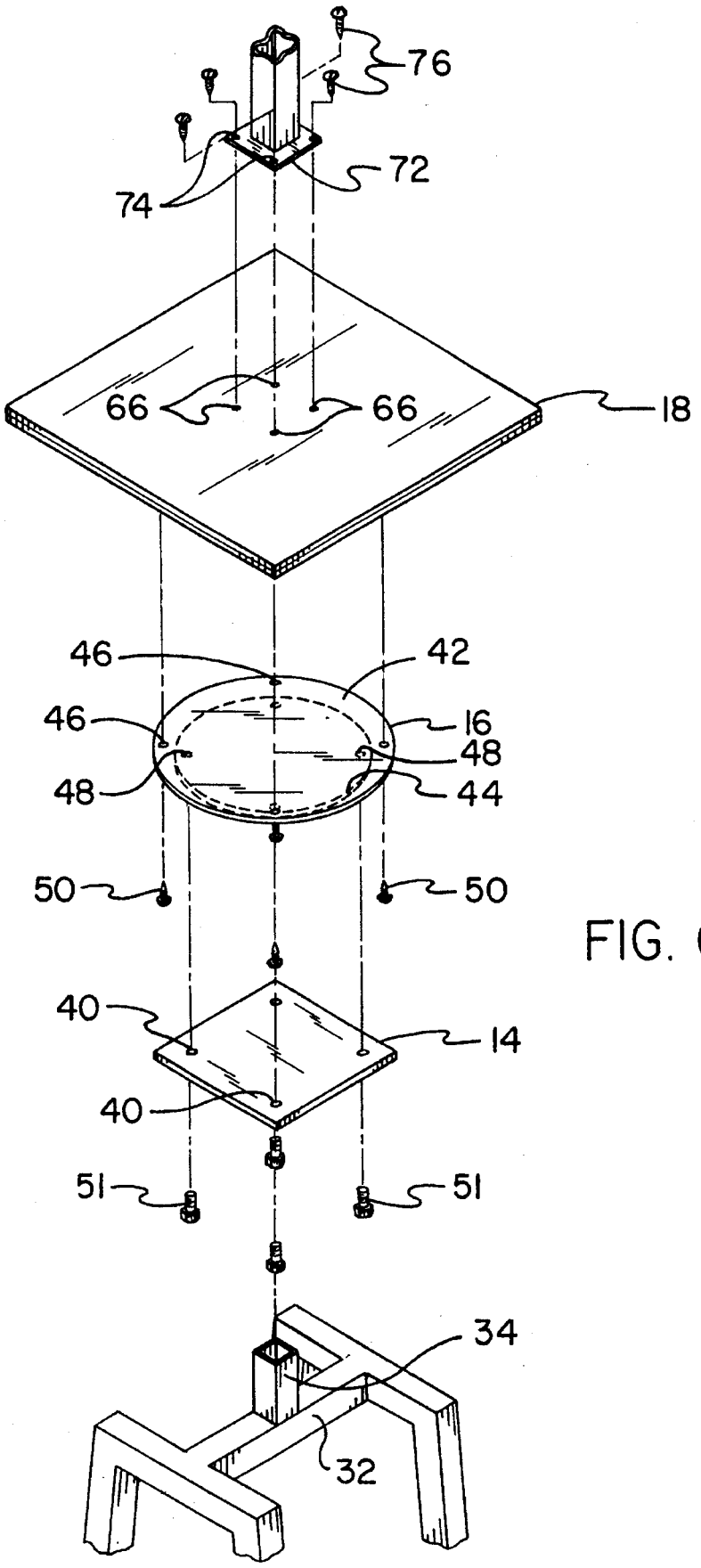
FIG. 6 is a separated perspective view of the apparatus illustrating the positioning of the various components and the bolts utilized to couple them together.

More specifically, the support stand 12 is fabricated of generally rectangular shaped steel tubing and includes two generally A-shaped segments 24. The steel tubing used throughout the apparatus is size 060. The sturdy construction of the stand permits it to support a significant amount of weight in the operative orientation. Each segment has two legs 26 which are angled outwardly from top to bottom. The vertical height of each leg is between about 30 and 33 inches. A top piece 28 is positioned horizontally across the upper extent of each leg. Note FIGS. 3 and 6.

A cylindrical shaped foot pad 30 is affixed to the lower extent of each leg. The foot pads include swivel means to enable the legs of the apparatus to adapt to the uneven surface of a floor. A cross bar 32 is welded to the top piece of each A-shaped segment. The width of the cross bar is between about 15 and 18 inches. The center point of the cross bar has an upperwardly extending 4 inch shaft 34. The legs of each opposing segment are coupled together by planar rectangular shaped rods 36. The rods add additional strength and stability to the apparatus. Note FIGS. 1 and 6.

A support plate 14 is fabricated of steel and formed in a planar rectangular configuration. The corners of the plate each have a circular hole 40 extending therethrough. The approximate center point of the plate is welded to the upper extent of the shaft 34. The shaft of the support stand provides the necessary clearance area for manipulation of the lock pin assembly. The plate is securely welded to the upper extent of the shaft to provide a firm base for the other components of the apparatus. Note FIGS. 3 and 6.

A one thousand pound lazy susan 16 has an upper segment 42 and a lower segment 44. Each segment is formed in a planar circular configuration. The upper segment has a larger diameter than the lower segment. The upper segment of the lazy susan is coupled to the worktable with four screws. The worktable rotates in a horizontal circular direction along with the upper segment of the lazy susan. The lower segment of the lazy susan is coupled to the pull handle. Note FIG. 3.

A plurality of bearings are positioned between the segments and permit rotation of one segment with respect to the other. The side of the table desired by the user is easily selected by rotating the pull handle. Each segment has four equidistantly spaced holes 46, 48 adjacent to their respective edges. Four bolts 51 couple the lower segment of the lazy susan to the support plate through their aligned holes. The releasably coupled components enable the user to easily dissemble the apparatus when desired. Note FIGS. 2 and 6.

Figure 5:
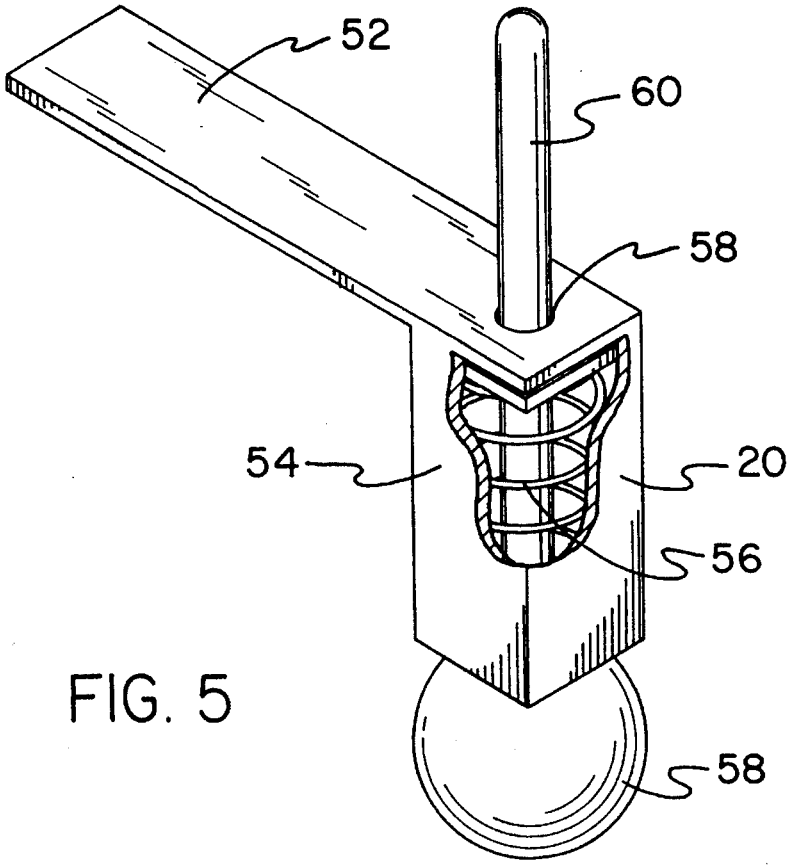
FIG. 5 is an exploded, partially broken away perspective view of the lock pin assembly of the apparatus.

A lock pin assembly 20 is formed in a generally L-shaped configuration. A first section 52 of the assembly is formed in a planar generally rectangular configuration and is affixed to the lower segment of the lazy susan. The table is easily rotated by forcing the pull handle in a downward direction and shifting it to the left or right. The second section 54 is formed as a downwardly extending rectangular box with a spring 56 positioned therein. The second section has an aperture 58 extending vertically through it. Note FIG. 5.

A pull handle 58 is formed as a spherical ball with an extension rod 60 extending upwardly from it. The rod is positioned through the apertures in the second section and coupled to the spring. The pull handle is pulled downward and shifted to rotate the table. The lower surface of the worktable has a semi-circular shaped bore at the approximate center point of each of its sides. The extension rod of the pull handle is positioned within the bores to lock the apparatus in place and prevent it from shifting during use. Note FIGS. 2 and 3.

To rotate the worktable the user simply pulls the handle downward to remove the extension shaft from its cooperatively coupled bore and shifts the handle to the left or right as desired. The user then selects the desired side of the worktable and positions the extension rod within the corresponding bore. Upon release of the handle the resilient spring forces the extension rod upward into the bore in the chosen side of the table thereby locking it in place. Each bore is approximately one inch in depth. The depth of the bore prevents shifting of the worktable during use. Note FIGS. 2 and 5.

A worktable 18 has a top piece 62 and a bottom piece 64. The pieces are fabricated of ¾ inch particle board. Each piece is formed in a planar rectangular configuration and has an upper surface and a lower surface. The pieces are coupled together with glue and screws. The edges of the table may be painted black or any other color desired by the user. This configuration adds additional strength to the apparatus. The worktable is fabricated of strong materials to enable it to support the heavy equipment which will be placed upon it during use. Note FIGS. 1 and 6.

Figure 4:
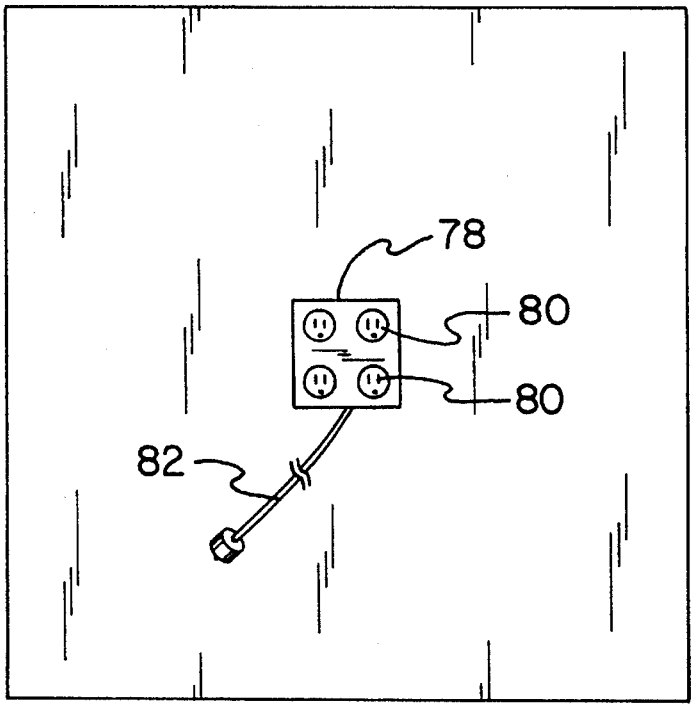
FIG. 4 is a top plan view of the apparatus illustrating the central positioning of the four outlet utility box.

The top piece has a plastic coating on its upper surface. The plastic coating ensures a firm and even surface upon which to work. The bores in the lower surface are adapted to receive the extension rod in the operative orientation. Note FIGS. 1, 4 and 6. Each piece has four screw holes 66 extending through it. The bottom piece is coupled to the upper segment of the lazy susan with four screws 50 through their aligned holes. The lower surface has a semi spherical shaped bore 68 adjacent to the center point of each of its four side edges. The bores are adapted to receive the extension rod in the operative orientation. Note FIGS. 3 and 5.

An extension pole 22 is fabricated of generally rectangular shaped 060 sized steel tubing and has an upper extent and a lower extent. The extension pole is approximately 24 inches in height. The lower extent includes a planar plate 72 with screw holes 74. The plate is coupled to the center point of the table with four screws 76. The extended height of the extension pole enables the user to work with several different electrical tools at once without having to be concerned about interference from the electrical cords of the various tools. The extended height of the extension pole also enables the user to plug electrical equipment into the utility box with a minimum of effort. Note FIGS. 1 and 2.

A four outlet utility box 78 is formed in a generally rectangular configuration. The box includes four electrical sockets 80 and the associated hardware. The box is affixed to the upper extent of the extension pole. The box includes an electrical extension cord 82 with a male outlet plug. The utility box is conveniently positioned upon the upper extent of the extension pole. The utility box is adapted to receive the male plugs and up to four pieces of electrical equipment at one time. The extension cord of the box may be manufactured in a variety of different lengths to suit the user's needs. The extended height of the extension pole prevents the cord from getting in the users way when utilizing equipment on the worktable. Note FIGS. 1 and 4.

The rotatable electrical equipment table is a work stand for up to four electrical tools which can be rotated to select a particular tool. The work stand is made of three fourths inch particle board. The worktable is square, between about twenty four and thirty inches across. The worktables made of two particle boards which are screwed and glued together. A twenty four inch long extension pole is welded to a small square plate that is fastened to the center of the tabletop. A four-plug utility box is welded to its upper end. A lazy susan is coupled to the center of the lower surface of the table. A steel sheet support plate is bolted to it. Welded to the center of the sheet is a four inch shaft with tow nuts welded on one side.

A lock pin assembly is welded to the lower segment of the lazy susan. A knob is screwed to the bottom of the rod of the lock pin assembly. The rod has a washer welded to it inside the assembly. A spring pushes the washer and rod up into one of four ½" deep bores. Each bore is ninety degrees apart in the lower surface of the table.

The frame is made of one and one-quarter inch square tubing. Two thirty three inch high and eighteen inch wide sides join three tubes in the center of the top piece. The upper crossbar has a four inch long tube welded to its top center. The support plate is welded to the top of the shaft. Leveler bolts are fastened in the ends of the frame.

The table is locked into position by the extension rod of the lock pin assembly. Pulling the knob down allows the table to be rotated. The apparatus is sturdy and can be indexed at ninety degree increments. It is adapted to provide electrical power without twisting the cords of the tools.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the U.S. is as follows:

1. A rotatable electrical equipment table comprising, in combination:

a support stand fabricated of generally rectangular shaped steel tubing and including two generally A-shaped segments, each segment having two legs angled outwardly from top to bottom, a top piece being positioned horizontally across the upper extent of each leg, a cylindrical shaped foot pad being affixed to the lower extent of each leg, a cross bar being welded to the top piece of each A-shaped segment, the center point of the cross bar having an upperwardly extending shaft, the legs of each opposing segment being coupled together by planar rectangular shaped rods;

a support plate being fabricated of steel and formed in a planar rectangular configuration, the corners of the plate each having a circular hole extending therethrough, the approximate center point of the plate being welded to the upper extent of the shaft;

a lazy susan adapted to hold up to one thousand pounds, the lazy susan having upper and lower segments formed in a planar circular configuration, the upper segment having a larger diameter than the lower segment, the segments being rotatably coupled to each other thereby permitting rotation of one segment with respect to the other, each segment having four equidistantly spaced holes adjacent to their respective edges, four screws coupling the lower segment of the lazy susan to the support plate through their aligned holes;

a lock pin assembly formed in a generally L-shaped configuration, a first section of the assembly formed in a planar rectangular configuration and affixed to the lower segment of the lazy susan, the second section formed as a downwardly extending rectangular box with a spring positioned therein, the second section having an aperture extending vertically therethrough, a pull handle formed as a spherical ball with an extension rod extending upwardly therefrom, the rod being positioned through the aperture in the second section and coupled to the spring, the pull handle being pulled downward to rotate the lazy susan, upon release the resilient spring forcing the extension rod in an upward direction;

a worktable having a top piece and a bottom piece, each piece formed in a planar rectangular configuration with an upper surface and a lower surface, the pieces being coupled together with glue and screws, the top piece having a plastic coating on its upper surface, each piece having four screw holes positioned therein, the bottom piece being coupled to the upper segment of the lazy susan with four screws through their aligned holes, the lower surface having a semi spherical shaped bore adjacent to the center point of each of its four side edges; and an extension pole fabricated of generally rectangular shaped steel tubing and having an upper extent and a lower extent, the lower extent including a planar plate with screw holes, the plate being coupled to the center point of the table with four screws, a four outlet utility box formed in a generally rectangular configuration, the box including four electrical sockets and the associated hardware, the box being affixed to the upper extent of the extension pole, the box including an electrical extension cord with a male outlet plug.

* * * * *